US005991717A

United States Patent [19]

Minde et al.

[11] Patent Number: 5,991,717

[45] Date of Patent: Nov. 23, 1999

[54] ANALYSIS-BY-SYNTHESIS LINEAR PREDICTIVE SPEECH CODER WITH RESTRICTED-POSITION MULTIPULSE AND TRANSFORMED BINARY PULSE EXCITATION

[75] Inventors: Tor Björn Minde, Gammelstad; Peter Alexander Mustel, Upplands Väsby, both of Sweden

[73] Assignee: Telefonaktiebolaget LM Ericsson, Stockholm, Sweden

[21] Appl. No.: 08/924,877

[22] Filed: Sep. 5, 1997

Related U.S. Application Data

[63] Continuation of application No. PCT/SE96/00296, Mar. 6, 1996.

[30] Foreign Application Priority Data

Mar. 22, 1995 [SE] Sweden ..... 9501026

[51] Int. Cl.[6] ..... G10L 9/14

[52] U.S. Cl. ..... 704/223; 704/203

[58] Field of Search ..... 704/220–223, 704/264, 500

[56] References Cited

U.S. PATENT DOCUMENTS 5,488,704 1/1996 Fujimoto ..... 704/219

5,752,223 5/1998 Aoyagi et al. ..... 704/219

*Primary Examiner*—David R. Hudspeth

*Assistant Examiner*—Donald L. Storm

*Attorney, Agent, or Firm*—Burns, Doane, Swecker & Mathis, L.L.P.

[57] ABSTRACT

An analysis-by-synthesis linear predictive speech coder is described. This speech coder has a synthesis part including an adaptive codebook for generating an adaptive excitation, means for generating a multi-pulse excitation and means for generating a transformed binary pulse excitation. The multi-pulse excitation generating means comprises means for generating pulses in restricted pulse positions. The multi-pulse excitation and the transformed binary pulse excitation are combined.

5 Claims, 7 Drawing Sheets

Microfiche Appendix Included
(1 Microfiche, 25 Pages)

AMP1
AMP2
AMP3
AMP4
AMP5
AMP6
7
9
14
25
29
37
4
5
6
8
SUB-BLOCK 1
SUB-BLOCK 2
SUB-BLOCK 3
SUB-BLOCK 4

ANALYSIS-BY-SYNTHESIS LINEAR PREDICTIVE SPEECH CODER WITH RESTRICTED-POSITION MULTIPULSE AND TRANSFORMED BINARY PULSE EXCITATION

This application is a continuation of International Application No. PCT/SE96/00296, filed Mar. 6, 1996, which designates the United States.

TECHNICAL FIELD

The present invention relates to an analysis-by-synthesis linear predictive speech coder. Such speech coders are used in e.g. cellular radio communication systems. This application includes a microfiche appendix consisting of 1 microfiche and 25 frames.

BACKGROUND

An analysis-by-synthesis speech coder [1] consists of three main components in the synthesis part, namely a linear predictive coding (LPC) synthesis filter, an adaptive code book and some type of fixed excitation. The synthesis of the speech is done by filtering an excitation vector through the LPC synthesis filter to produce the synthetic speech signal. The excitation vector is formed by adding together scaled versions of vectors coming from the adaptive code book and the fixed excitation. The analysis part of an analysis-by-synthesis coder consists mainly of the LPC analysis and the excitation analysis. The excitation analysis is a search for the indices or other parameters for the excitation, e.g. indices for the code book, gain parameters for the excitation or the amplitudes and positions for excitation pulses.

The used excitation structure in an analysis-by-synthesis speech coder is essential for the quality of the reconstructed speech, the complexity of the search and the robustness to bit errors. To achieve high quality the excitation needs to be rich, i.e. contain both pulse-like and noise-like components. To achieve low complexity the excitation needs to be somewhat structured, due to the fact that the search for the excitation code tends to be of low complexity in a structured code book. To achieve high robustness in a mobile radio environment the bit error sensitivity for the unprotected bits of the excitation code must be low.

To achieve excitation richness so called mixed excitation procedures have been proposed [2–8]. The mix usually consists of pulse and noise sequences. Pulse-like excitations are needed in onsets, plosive and voiced sections of the speech. Noise-like sequences are needed for unvoiced sounds.

To achieve low complexity structured excitation several methods have been proposed. Multi-pulse excitation (MPE) has been described in [9] and consists of pulses described by a position and an amplitude. Regular pulse excitation (RPE) has been described in [10] and consists of a sequence of regularly (equidistant) spaced pulses described by a grid (position of the first pulse) and pulse amplitudes. Transformed binary pulse excitation (TBPE) is described in [11–12] and consists of a binary sequence of pulses that are transformed by a shaping matrix to obtain a gaussian-like sequence of regularly spaced pulses. Vector sum excitation (VSE) is described in [13] and consists of a number of basis vectors that are combined into an output vector. The basis vectors are multiplied with either +1 or −1 and summed to form the excitation vector. Low complexity search methods exist for all these structured excitations.

To achieve robustness protection of the most significant bit [14], index assignment [15] and phase position coding [16] have been proposed.

SUMMARY

An object of the present invention is an analysis-by-synthesis linear predictive speech coder that provides both high quality (excitation richness), low search complexity and high robustness in a mobile radio environment.

This problem is solved with a speech coder having a synthesis part including means for generating a multi-pulse excitation, means for generating a transformed binary pulse excitation and means for combining said multi-pulse excitation and said transformed binary pulse excitation.

BRIEF DESCRIPTION OF THE DRAWINGS

The invention, together with further objects and advantages thereof, may best be understood by making reference to the following description taken together with the accompanying drawings, in which:

FIGS. 5 *a–e* illustrates the principles of phase position coded multi-pulse excitation;

DETAILED DESCRIPTION

The following description will refer to the European GSM system. However, it is appreciated that the principles of the present invention may be applied to other cellular systems as well.

Figure 1:
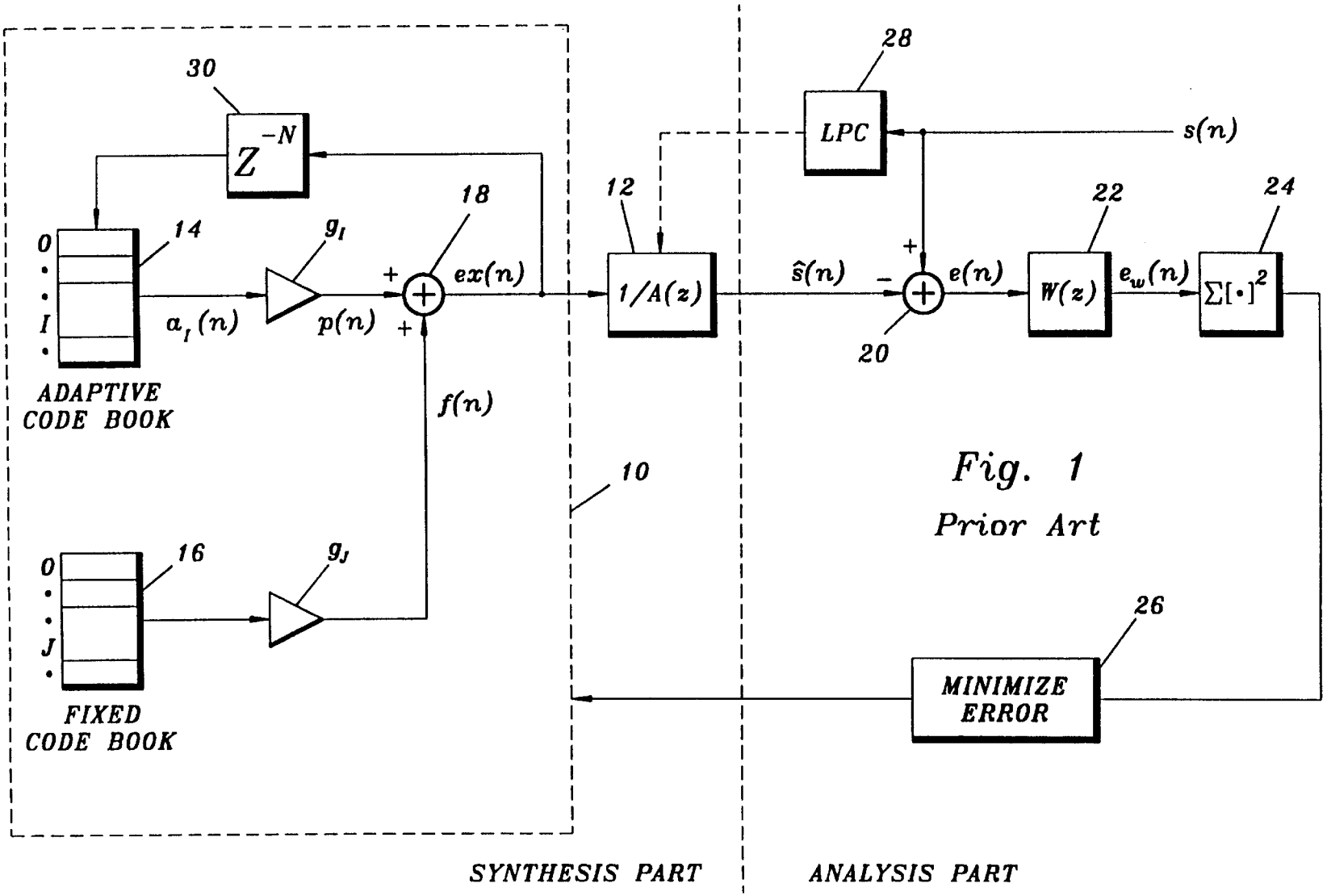
Fig. 1 Prior Art
FIG. 1 is a block diagram of a typical analysis-by-synthesis linear predictive speech coder.

FIG. 1 shows a block diagram of a typical analysis-by-synthesis linear predictive speech coder. The coder comprises a synthesis part to the left of the vertical dashed center line and an analysis part to the right of said line. The synthesis part essentially includes two sections, namely an excitation code generating section 10 and an LPC synthesis filter 12. The excitation code generating section 10 comprises an adaptive code book 14, a fixed code book 16 and an adder 18. A chosen vector $a_I(n)$ from the adaptive code book 14 is multiplied by a gain factor $g_I$ for forming a signal p(n). In the same way an excitation vector from the fixed code book 16 is multiplied by a gain factor $g_f$ for forming a signal f(n). The signals p(n) and f(n) are added in adder 18 for forming an excitation vector ex(n), which excites the LPC synthesis filter 12 for forming an estimated speech signal vector ŝ(n).

In the analysis part the estimated vector ŝ(n) is subtracted from the actual speech signal vector s(n) in an adder 20 for forming an error signal e(n). This error signal is forwarded to a weighting filter 22 for forming a weighted error vector $e_w(n)$. The components of this weighted error vector are squared and summed in a unit 24 for forming a measure of the energy of the weighted error vector.

A minimization unit 26 minimizes this weighted error vector by choosing that combination of gain $g_l$ and vector from the adaptive code book 14 and that gain $g_f$ and vector from the fixed code book 16 that gives the smallest energy value, that is which after filtering in filter 12 best approximates the speech signal vector s(n). This optimization is divided into two steps. In the first step it is assumed that f(n)=0 and the best vector from the adaptive code book 14 and the corresponding $g_l$ are determined. An algorithm for determining these parameters is given in the enclosed APPENDIX. When these parameters have been determined a vector and corresponding gain $g_f$ are chosen from the fixed code book 16 in accordance with a similar algorithm. In this case the determined parameters of the adaptive code book 14 are locked to their determined values.

The filter parameters of filter 12 are updated for each speech signal frame (160 samples) by analyzing the speech signal frame in a LPC analyzer 28. This updating has been marked by the dashed connection between analyzer 28 and filter 12. Furthermore, there is a delay element 30 between the output of adder 18 and the adaptive code book 14. In this way the adaptive code book 14 is updated by the finally chosen excitation vector ex(n). This is done on a subframe basis, where each frame is divided into four subframes (40 samples).

As has been noted above the used excitation structure of the fixed code book is essential for the quality of the reconstructed speech, the complexity of the search and the robustness to bit errors. To achieve high quality the excitation needs to be rich, i.e. contain both pulse-like and noise-like components. To achieve low complexity the excitation needs to be somewhat structured. The search for the excitation code tends to be of relatively low complexity in a structured code book. To achieve high robustness in a mobile radio environment the bit error sensitivity for the unprotected bits of the excitation code must be low. This is not as important for the protected (channel coded) bits of the excitation code. Thus, the bit error sensitivity in the excitation code should differ between protected and unprotected bits. Usually the unprotected class of bits will limit the performance in high BER channels.

As mentioned above high robustness may be achieved by channel coding protection, but bandwidth constraints usually limit this to 60–80% overhead for redundant channel coding of bits. Since in general a coding rate about ½ or more is needed for high performance, not all bits may be protected. Some of the bits need to be very robust to bit errors to be sent without channel protection. Thus, the bits of the speech coding need to have strongly unequal error sensitivity. To achieve very high performance special attention has to be given to the fact that the unprotected bits usually limit the performance.

Figures 2, 5A, 5B, 5C, 5D, 5E:
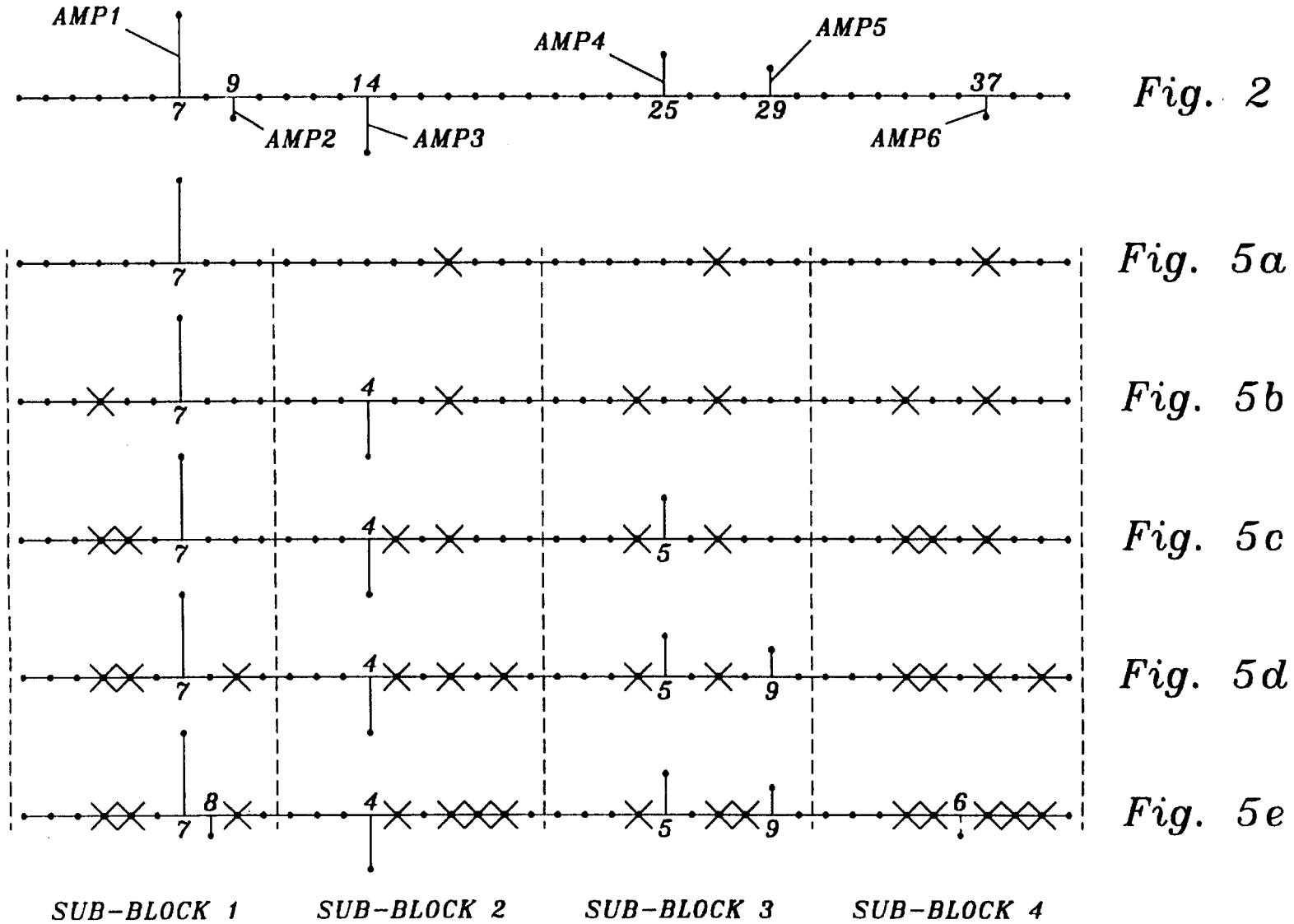
FIG. 2 illustrates the principles of multi-pulse excitation (MPE)
Figure 3:
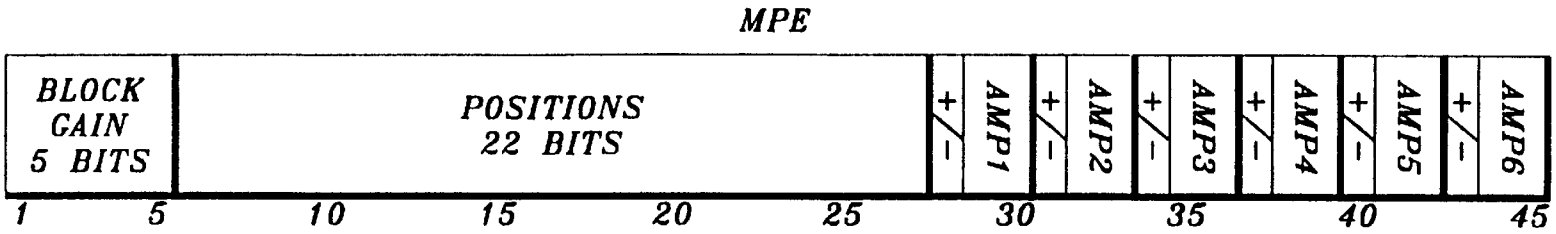
FIG. 3 illustrates a bit allocation scheme for a multi-pulse excitation.

Multi-pulse excitation, which is illustrated in FIG. 2, is known to provide high quality at higher bit rates. For example 6–8 pulses per 40 samples (or 5 milliseconds) is known to give good quality. FIG. 2 illustrates 6 pulses distributed over a subframe. The excitation vector may be described by the positions of these pulses (positions 7, 9, 14, 25, 29, 37 in the example) and the amplitudes of the pulses (AMP1–AMP6 in the example). Methods for finding these parameters are described in [9]. Usually the amplitudes only represent the shape of the excitation vector. Therefore a block gain is used to represent the amplification of this basic vector shape. FIG. 3 shows an example of the format of the bit distribution of a typical multi-pulse excitation consisting of six pulses. In this example five bits are used for a scalar quantized block gain (scaling of the pulses), one bit is used for each pulse sign, two bits for the scalar quantization of each pulse amplitude and (40 over 6)=22 bits for pulse position coding using a combinatorial position coding scheme (see [1] p. 360 and Appendix). This adds up to 5+6+12+22=45 bits/5 ms=9 kb/s.

Figure 4:
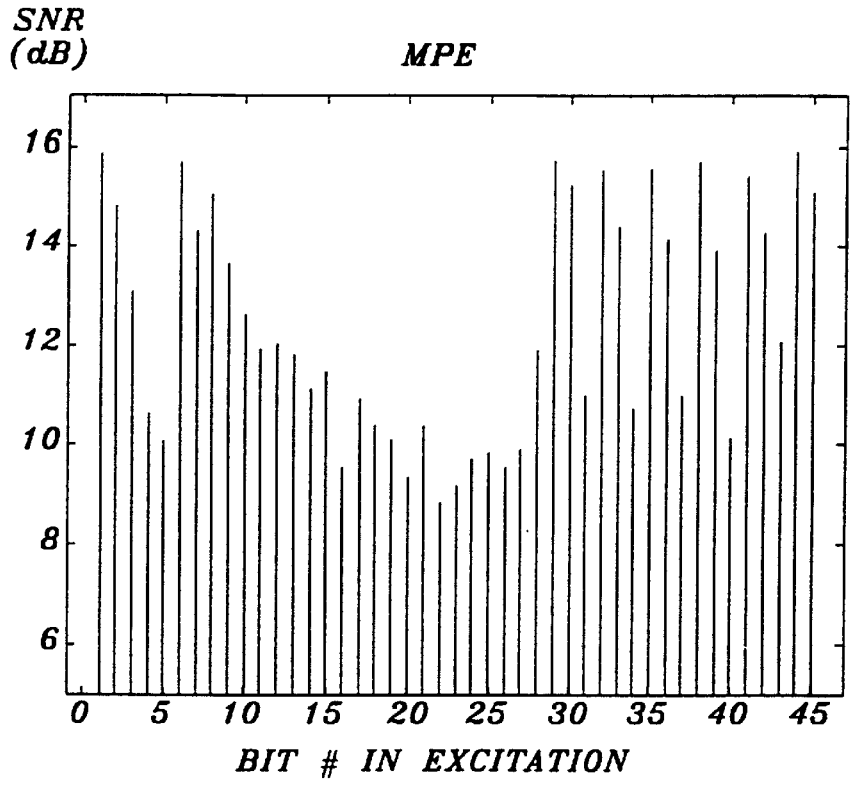
FIG. 4 is a diagram illustrating the bit error sensitivity of the multi-pulse excitation defined in FIG. 3.

The bit error sensitivity of the multi-pulse excitation is known to be relatively high for some of the bits. This is illustrated in FIG. 4. The figure illustrates the signal-to-noise ratio of reconstructed speech for 100% BER in each bit position of the excitation. Thus, each bit position in the format of FIG. 3 is individually set to the wrong value, while all other bit positions are correct. The reconstructed signal is compared to the original signal and the signal-to-noise ratio is computed. Thus, the length of each line in FIG. 4 represents the sensitivity of the reconstructed speech to an error in that bit position. In the figure high SNR indicates low bit error sensitivity.

From FIG. 4 it can be seen that the most significant bits of the block gain (bits 3–5) are very sensitive to bit errors, while the least significant bits of the block gain) bits 1–2 are less sensitive. Furthermore, the signs of the pulses (bits 28, 31, 34, 37, 40 and 43) are also very sensitive to bit errors. The amplitude bits (bits 29, 30, 32, 33, 35, 36, 38, 39, 41, 42, 44 and 45) are less sensitive to bit errors. Depending on the position coding scheme used the pulse position bits (bits 6–27) are more or less sensitive to bit errors. For a combinatorial scheme, as in FIGS. 3 and 4, all pulse positions are jointly coded into one code word. Bit errors in that code word will move all the pulse positions around, making many of the bits (bits 11–27) sensitive to bit errors.

One way to reduce the bit error sensitivity of the pulse position coding is to restrict the pulse positions. One coding scheme of this type is phase position coding [16]. This pulse position coding scheme has higher coding efficiency than a combinatorial scheme, but the trade off is somewhat lower speech quality. The principles of phase position coding are illustrated in FIGS. 5*a*–*e*. In phase position coding the total number of positions are divided into a number of sub-blocks, 4 sub-blocks in the figure. Each sub-block contains a number of phases, ten phases in the figure. A restriction is imposed on the allowable pulse position. There is only one pulse allowed in each phase. This means that the positions can be coded by describing the phase positions and sub-block positions of the pulses. The phase positions are coded using a combinatorial scheme. The most significant bits of the sub-block positions will have high bit error sensitivity. On the other hand, the least significant bits of the phase position code words will have lower bit error sensitivity.

In FIGS. 5*a*–*e* it is assumed that the pulses are generated by the same signal as the pulses in FIG. 2. In the first step the position of the strongest pulse is determined. This corresponds to the pulse in position 7 of FIG. 2. This pulse has been indicated in FIG. 5*a*. Since pulse position 7 corresponds to phase 7, phase 7 of all the other sub-blocks has been crossed out as a forbidden pulse position for the remaining pulses. In FIG. 5*b* the second strongest pulse is determined in position 14, which corresponds to sub-block 2 and phase 4, which means that phase 4 is forbidden for the remaining pulses. In FIGS. 5*c* and 5*d* the pulses in positions 25 and 29 are determined in a similar way. The next pulse to be determined is the pulse corresponding to the pulse in position 9 of FIG. 2. However, phase 9 is now forbidden. Therefore the pulse has to be positioned in one of the phase positions that are still allowed. The position chosen is that which gives the best approximation of the target excitation. In the example the pulse is positioned in phase 8 of sub-block 1. Note that since the pulse has been shifted relative to the corresponding pulse (AMP2) in FIG. 2, the amplitude may also have changed. Finally, the remaining pulse corresponding to the pulse in position 37 in FIG. 2 is determined. This phase (7) is also forbidden. Instead a pulse is generated in phase position 6 of sub-block 4. This pulse has been indicated by a dashed line in FIG. 5*e*.

One major problem with multi-pulse excitation is that the decoder at the receiving end does not know which of the pulses that are most important. The most important pulses are also the pulses that are most sensitive to bit errors. The most important pulses are usually found first in the sequential search in the coder and usually have the largest amplitudes. However, due to the position coding the most sensitive information is spread out over the bits. This increases the level of sensitivity for all bits instead of giving an unequal bit error sensitivity, as would be desirable. One solution to this would be to split the pulses into two groups. The first group would consist of the first found pulses. This would make the first group more sensitive to bit errors. Furthermore, to split the excitation coding into two parts and using phase position coding will make the bits more unequal in bit error sensitivity. A drawback of the splitting method is that the coding efficiency of the second group is lower. Thus, a more efficient coding of the second group of the excitation is needed. Low error sensitivity is also needed, since these bits are candidates for being sent unprotected.

A stochastic code book excitation is known to provide high quality at lower bit rates than a multi-pulse excitation. However, the complexity to search a stochastic code book is high, making implementation difficult, if not impossible. Techniques to lower the complexity exist, e.g. shifted sparse code books. However, even with these techniques the complexity is still too high for higher bit rates. Another drawback is the bit error sensitivity. A single bit error will make the decoder use a totally different stochastic sequence from the code book.

The transformed binary pulse excitation (TBPE) is known to provide close to stochastic excitation efficiency at equivalent bit rates. The structure of such a code book makes the search highly efficient. The storage requirement in ROM is also low. The transformation matrices are used to make the excitation more gaussian-like. The inherent structure with regular spacing of the pulses make the excitation sparse. The main drawback of this method is that the quality drops when the low complexity search methods are kept while the code book size is increased. The regular spacing limits the increase in performance when the bit rate is increased. TBPE is described in detail in [11–12] and is further described below with reference to FIGS. 6*a–b*.

Figure 6A:
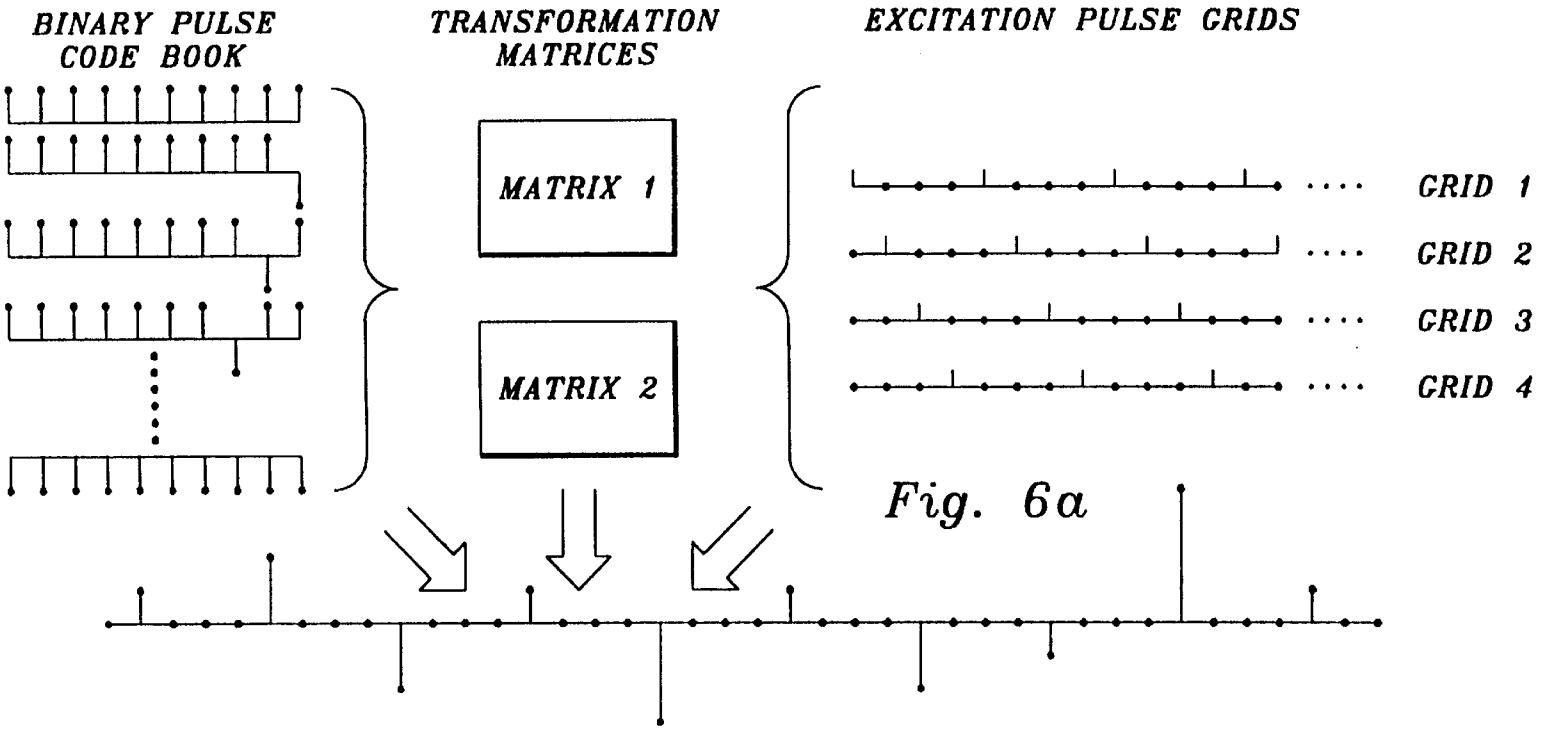
FIG. 6*a* illustrates the principles of transformed binary pulse excitation (TBPE)

FIG. 6*a* illustrates the principles behind transformed binary pulse excitation. The binary pulse code book may comprise of vectors containing for example 10 components. Each vector component points either up (+1) or down (−1) as illustrated in FIG. 6*a*. The binary pulse code book contains all possible combinations of such vectors. The vectors of this code book may be considered as the set of all vectors that point to the "corners" of a 10-dimensional "cube". Thus, the vector tips are uniformly distributed over the surface of a 10-dimensional sphere.

Furthermore, TBPE contains one or several transformation matrices (MATRIX 1 and MATRIX 2 in FIG. 6*a*). These are precalculated matrices stored in ROM. These matrices operate on the vectors stored in the binary pulse code book to produce a set of transformed vectors. Finally, the transformed vectors are distributed on a set of excitation pulse grids. The result is four different versions of regularly spaced "stochastic" code books for each matrix. A vector from one of these code books (based on grid 2) is shown as a final result in FIG. 6*a*. The object of the search procedure is to find the binary pulse code book index of the binary code book, the transformation matrix and the excitation pulse grid that together give the smallest weighted error.

Figure 6B:
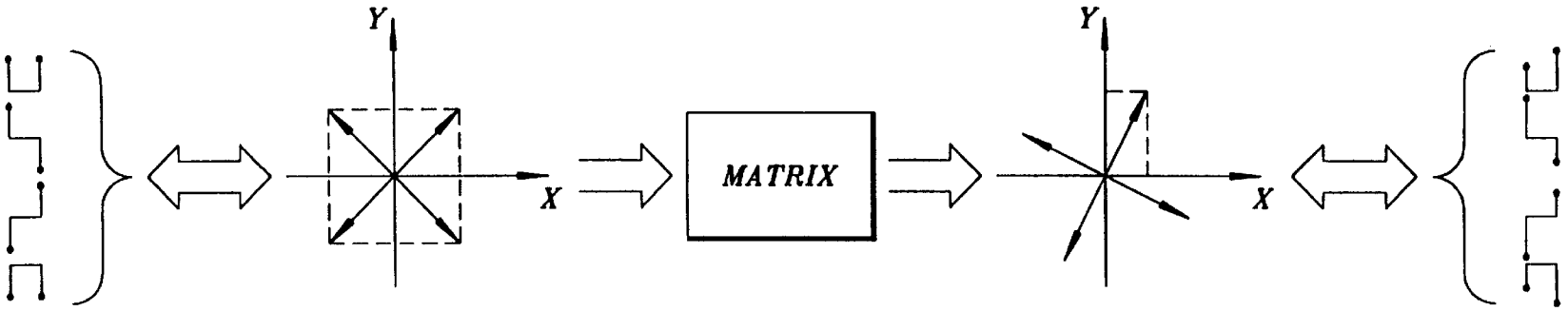
FIG. 6*b* illustrates TBPE for a special case of only two pulses.

The matrix transformation step is further illustrated in FIG. 6*b*. In this case the binary pulse code book is assumed to consist of only two positions (this is an unrealistic assumption, but it helps to illustrate the principles behind the transformation step). All the possible binary vectors of the binary pulse code book are illustrated in the left part of FIG. 6*b*. These vectors may be considered as being equivalent to vectors pointing to the corners of a 2-dimensional "cube", which is a square, that has been indicated by dotted lines in the left part of FIG. 6*b*. These vectors are now transformed by a matrix. This matrix may for example be an orthogonal matrix, which rotates the entire "cube". The transformed binary vectors comprise the projections of the individual transformed vectors on the X- and Y-axes, respectively. The resulting transformed binary code is illustrated in the right part of FIG. 6*b*. After transformation the transformed vectors are distributed on a set of grids, as explained with reference to FIG. 6*a*.

Figure 7:
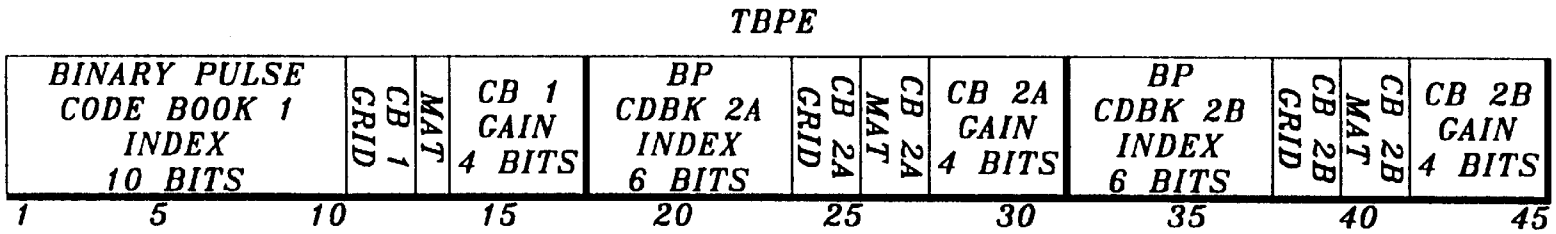
FIG. 7 illustrates a bit allocation scheme for a transformed binary pulse excitation.

FIG. 7 shows the bit allocation format of a typical TBPE excitation. In this example a two stage TBPE code book is used, in which TBPE code book 1 is a 40 sample code book and the second stage is divided into two 20 sample TBPE code books 2A, 2B. Code book 1 uses ten bits for the binary pulse code book index, two bits for the grids of code book 1, one bit for the matrices of code book 1 and four bits for the gain of code book 1. Code books 2A, 2B use 2×6 bits for binary pulse code book indices, 2×2 bits for code book grids, 2×2 bits for code book matrices and 2×4 bits for code book gains. This adds up to 45 bits/5 ms=9 kb/s.

Figure 8:
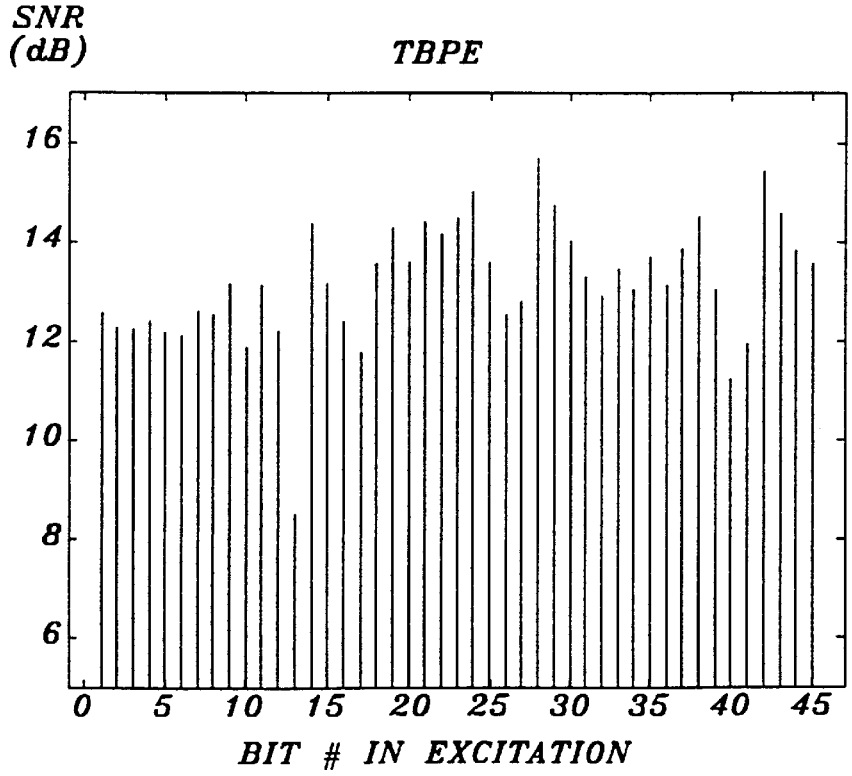
FIG. 8 is a diagram illustrating the bit error sensitivity of the transformed binary pulse excitation.

The bit error sensitivity for the transformed binary pulse excitation defined in FIG. 7 is shown in FIG. 8. The inherent structure of TBPE gives a gray-coded index in the binary pulse code books. This means that code words close in hamming distance are also close in excitation vector distance. A single bit error will only change the sign of one of the regular pulses. Therefore the bit positions in the index have roughly equal sensitivity in FIG. 8 (bits 1–10 for binary pulse code book 1, bits 18–23 for binary pulse code book 2A and bits 32–37 for binary pulse code book 2B). The first code book including index, grid and matrix (bits 1–10, 11–12, 13) has higher sensitivity. The matrix bit (bit 13) shows a very high sensitivity in this example. Furthermore, the code book gain of the first code book (bits 14–17) shows higher sensitivity than the second code book gains (bits 28–31, 42–45). One problem is that the sensitivity is spread out over the bits. The sensitivity is generally lower than for multi-pulse excitation bits, but there is only a weakly unequal error sensitivity. However, the structure combines inherent index assignment and low complexity. This makes TBPE a strong candidate for replacing the second part of the multi-pulse excitation discussed above.

The structure proposed in the present invention is a mixed excitation using a few multi-pulses and a TBPE code book. The positions of the pulses are preferably coded with a restricted position coding scheme, such as phase position coding described above. The mixed excitation using pulses and transformed binary pulse (noise) sequences improve quality. The MPE and TBPE searches are low complexity schemes. The mix of multi-pulse bits and TBPE shows strongly unequal error sensitivity, which fits into an unequal error protection scheme with some bits unprotected.

Figure 9:
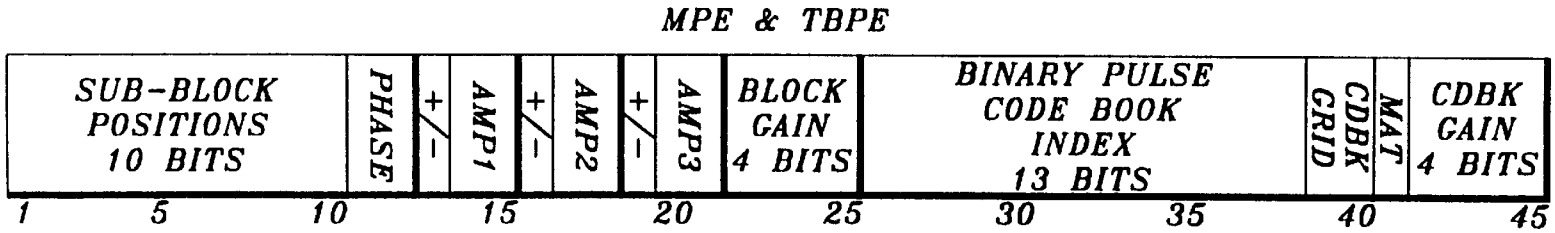
FIG. 9 illustrates a bit allocation scheme for a combined multi-pulse and transformed binary pulse excitation in accordance with a preferred embodiment of the present invention.

FIG. 9 illustrates an example of the format of the bit allocation in a preferred embodiment of the present invention. In this example there are three multi-pulses and one 13 bit index (13 binary pulses) TBPE code book with four grids and two matrices. Phase position coding is performed using ten sub-blocks and four phases. This gives 3×2 log (10)=10 bits for the sub-block positions and (4 over 3)=2 bits for the phase code words, 3×1 bits for the pulse signs, 3×2 bits for the pulse amplitudes, four bits for the block gain, 13 bits for the binary pulse code book index, 2 bits for the grid, 1 bit for the matrix and four bits for the code book gain. This all adds up to 10+2+3+6+4+13+2+1+4=45 bits/5 ms=9 kb/s.

Figure 10:
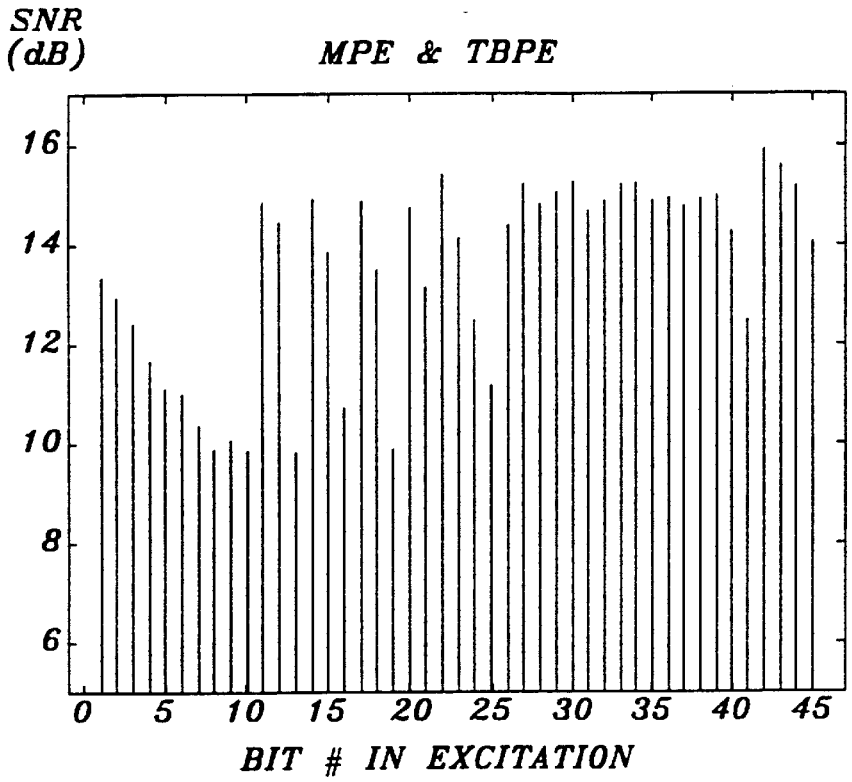
FIG. 10 is a diagram illustrating the bit error sensitivity of the combined multi-pulse and transformed binary pulse excitation in accordance with a preferred embodiment of the present invention.

FIG. 10 illustrates the bit sensitivity of the mixed excitation in accordance with the preferred embodiment of the invention. From FIG. 10 it is apparent that the few multi-pulses (bits 1–21) are more sensitive to bit errors than the TBPE code book index (bits 26–41). The phase position coding makes some of the bits for the pulse positioning less sensitive to bit errors (bits 1–3 of the sub-block positions and bits 11–12 of the phase code words). The amplitudes of the pulses (bits 14–15, 17–18, 20–21) are less sensitive than the signs (bits 13, 16, 19). The bits in the TBPE index (bits 26–38) are equal in sensitivity and the sensitivity is very low compared to the pulse signs and positions. Some of the bits of the multi-pulse block gain (bits 24–25) are more sensitive. The bit for the transformation matrix (bit 41) is also sensitive.

Figure 11:
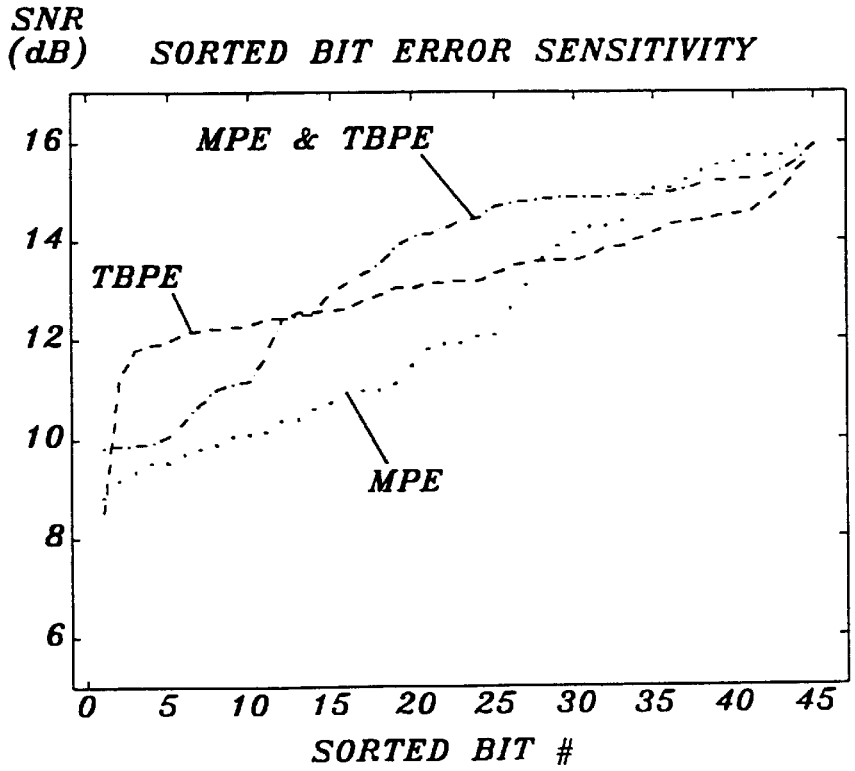
FIG. 11 compares the bit error sensitivities illustrated in FIGS. 4, 8 and 10, sorted by bit error sensitivity.

The three schemes discussed in this application and illustrated in FIGS. 4, 8 and 10 are compared with respect to error sensitivity in FIG. 11. In FIG. 11 the bits of each scheme have been sorted in bit error sensitivity order from highest to lowest sensitivity. From FIG. 11 it can be seen that the multi-pulse excitation (MPE) and the mixed excitation (MPE & TBPE) have the strongest unequal error sensitivity. The TBPE excitation has the most even sensititivy, and this sensitivity is generally lower than for the MPE excitation. The mixed excitation generally has lower sensititivy than the multi-pulse excitation, which makes the mixed excitation more robust. The mixed excitation also has some very sensitive bits (bits 1–12) and the some insensitive bits (bits 25–45), which makes this excitation perfect for unequal error protection. Since the number of unsensitive bits is larger for the mixed excitation than for the multi-pulse excitation, the performance of the unprotected class of bits will be better in low quality channels.

Figure 12:
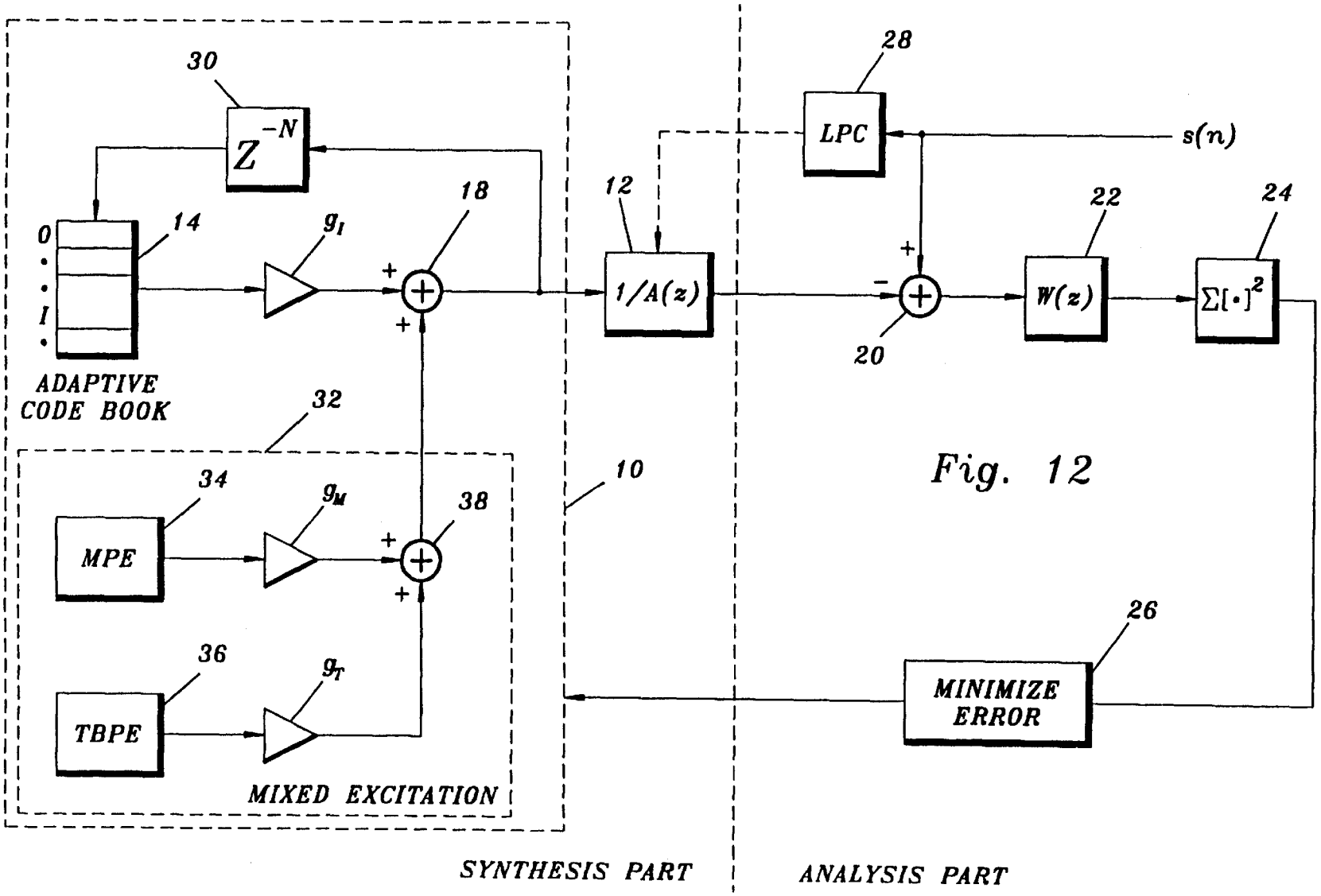
FIG. 12 is a block diagram of a preferred embodiment of a speech coder in accordance with the present invention.

FIG. 12 illustrates a preferred embodiment of a speech coder in accordance with the present invention. The essential difference between the speech coder of FIG. 1 and the speech coder of FIG. 12 is that the fixed code book 16 of FIG. 1 has been replaced by a mixed excitation generator 32 comprising the multi-pulse excitation (MPE) generator 34 and a transformed binary pulse excitation (TBPE) generator 36. The corresponding block gains have been denoted $g_M$ and $g_T$, respectively, in FIG. 12. The excitations from generators 34, 36 are added in an adder 38, and the mixed excitation is added to the adaptive code book excitation in adder 18.

An example of an algorithm used in the mixed excitation coder structure in accordance with the present invention is shown below. The algorithm contains all parts that are relevant in a speech encoder. The algorithm consists of six main sections. The MPE and TBPE sections, which constitute the mixed excitation are expanded to show the contents of the mixed excitation structure analysis. One frame based section, e.g. for each 160 sample frame, is the LPC analysis section, which calculates and quantizes the short-term synthesis filter. The remaining five sections are sub-frame based, e.g. they are performed for each 40 sample sub-frame. The first of these is the sub-frame preprocessing, i.e. parameter extraction; the second is the long-term analysis or adaptive code book analysis; the third is the MPE analysis; the fourth is the TBPE analysis; and the fifth is the state update.

EXAMPLE ALGORITHM

```
LPC analysis
For each subframe (1–4) do
  Subframe preprocessing
  LTP analysis (adaptive code book search)
  Multi-pulse excitation (MPE)
  Calculate impulse response of weighting filter
  Calculate autocorrelation function of impulse response
  Calculate cross correlation function between impulse
    response and weighted residual after LTP analysis
  Search MPE positions and amplitudes
  Quantize amplitudes and block gain
  Make MPE innovation vector
  Form position code words
  Form new weighted residual after MPE analysis
  Transformed binary pulse excitation (TBPE)
  Calculate impulse response of weighting filter
  Calculate cross correlation function between impulse
    response and weighted residual after MPE analysis
  For each matrix do
    For each grid do
      Calculate matrix cross correlation function
      Approximate pulses with sign of cross correlation
        function
      Form weighted TBPE innovation and compare
  Form TBPE code words
  Quantize TBPE gain
  Form TBPE innovation vector
  State update
```

A detailed description of this algorithm may be found in the microfiche appendix.

It will be understood by those skilled in the art that various modifications and changes may be made to the present invention without departure from the spirit and scope thereof, which is defined by the appended claims.

APPENDIX

This APPENDIX summarizes an algorithm for determining the best adaptive code book index i and the corresponding gain $g_i$ in an exhaustive search. The signals are also shown in FIG. 1.

| | |
|---|---|
| $ex(n) = p(n)$ | Excitation vector ($f(n) = 0$) |
| $p(n) = g_i \cdot a_i(n)$ | Scaled adaptive code book vector |
| $s(n) = h(n)*p(n)$ | Synthetic speech (* = convolution) |
| $e(n) = s(n) - \hat{s}(n)$ | Error vector |
| $e_w(n) = w(n)*(s(n) - s(n))$ | Weighted error |
| $E = \sum [e_w(n)]^2 \quad n = 0 \ldots N-1$ | Squared weighted error |
| $N = 40$ (for example) | Vector length |
| $s_w(n) = w(n)*s(n)$ | Weighted speech |
| $h_w(n) = w(n)*h(n)$ | Weighted impulse response for synthesis filter |
| $\min E_i = \min \sum_{n=0}^{N-1} [e_{w_i}(n)]^2$ | Search optimal index in the adaptive code book |
| $\frac{\partial E_i}{\partial g_i} = 0 \Rightarrow g_i = \frac{\sum_{n=0}^{N-1} s_w(n) \cdot a_i(n) * h_w(n)}{\sum_{n=0}^{N-1} [a_i(n) * h_w(n)]^2}$ | Gain for index i |

CITATIONS

[1] P. Kroon, E. Deprettere
A class of analysis-by-synthesis predictive coders for high quality speech coding at rates between 4.6 and 16 kbit/s.
IEEE Jour. Sel. Areas Com., Vol. SAC-6, No. 2, February 1988.

[2] H. Chen, W. C. Wong, C. C. Ko
Low-delay hybrid vector excitation linear predictive speech coding
Electronics letters Vol. 29 no. 25 1993

[3] D. Lin
Code-excited linear prediction using a mixed source model Proc. ASSP DSP workshop, 1986

[4] D. Lin
Ultra-fast CELP coding using deterministic multi-codebook innovations.
IEEE ICASSP-92, San Francisco, 1992.

[5] N. Moreau, P. Dymarski
Mixed excitation celp coder.
Eurospeech-89, Paris, September 1989.

[6] K. Ozawa
A hybrid speech coding based on multi-pulse and CELP at 3.2 kb/s.
IEEE ICASSP-90, Albuquerque, 1990.

[7] R. Zinser, S. Koch
4800 and 7200 bit/sec hybrid codebook multipulse coding.
IEEE ICASSP-89, Glasgow, 1989

[8] R. Zinser
Hybrid switched multi-pulse/stochastic speech coding technique.
U.S. Pat. No. 5,060,269

[9] B. Atal, J. Remde
A new model of LPC excitation for producing natural-sounding speech at low bit rates.
IEEE ICASSP-82, Paris, 1982.

[10] P. Vary, K. Hellwig, R. Hofmann
A regular-pulse excited linear predictive codec.
Speech Communication 7, North-Holland, 1988.

[11] R. A. Salami
Binary code excited linear prediction (BCELP): New approach to celp coding of speech without codebooks.
Electronics letters, vol. 25 no. 6 March 1989.

[12] R. Salami
Binary pulse excitation: A novel approach to low complexity CELP coding.
Kluwer Academic Pub., Advances in speech coding, 1991.

[13] I. Gerson, M. Jasiuk
Vector sum excited linear prediction (VSELP).
Kluwer Academic Pub., Advances in speech coding, 1991.

[14] R. Cox, W. B. Kleijn, P. Kroon
Robust celp coders for noisy backgrounds and noisy channels.
IEEE ICASSP-89, Glasgow, 1989.

[15] N. Cox
Error control and index assignment for speech codecs.
Kluwer Academic Press, 1993.

[16] T. B. Minde
Excitation pulse positioning method in a linear predictive speech coder.
U.S. Pat. No. 5,193,140

We claim:

1. An analysis-by-synthesis linear predictive speech coder, having a synthesis part comprising:

means for generating a multi-pulse excitation, wherein the multi-pulse excitation generating means comprises means for generating pulses in restricted pulse positions;

means for generating a transformed binary pulse excitation; and means for combining the multi-pulse excitation and the transformed binary pulse excitation.

2. The speech coder of claim 1, wherein the multi-pulse excitation generating means comprises means for phase position coding.

3. An analysis-by-synthesis linear predictive speech coder, having a synthesis part comprising:

an adaptive code book for generating an adaptive excitation;

means for generating a multi-pulse excitation, wherein the multi-pulse excitation generating means comprises means for generating pulses in restricted pulse positions;

means for generating a transformed binary pulse excitation; and means for combining said multi-pulse excitation and said transformed binary pulse excitation.

4. The speech coder of claim 3, wherein the multi-pulse excitation generating means comprises means for phase position coding.

5. The speech coder of claim 3, further comprising means for combining said multi-pulse, transformed binary pulse and adaptive excitations.

* * * * *